United States Patent [19]

Lounsberry, Jr., deceased

[11] 4,334,596

[45] Jun. 15, 1982

[54] HYDRAULIC FLUID-OPERATED RAILWAY TRACK LUBRICATING APPARATUS

[75] Inventor: Stephen M. Lounsberry, Jr., deceased, late of Nichols, N.Y.

[73] Assignee: Moore and Steele Corporation, Owego, N.Y.

[21] Appl. No.: 210,621

[22] Filed: Nov. 26, 1980

[51] Int. Cl.[3] ..... B61K 3/00

[52] U.S. Cl. ..... 184/3 A

[58] Field of Search ..... 184/3 A, 3 R; 417/405; 418/200

[56] References Cited

U.S. PATENT DOCUMENTS

| | | | |
|---|---|---|---|
| 2,349,259 | 5/1944 | Fuller | 184/3 A |
| 2,355,241 | 8/1944 | Rodman et al. | 184/3 A |
| 2,401,303 | 6/1946 | Huber | 184/3 A |
| 2,486,600 | 11/1949 | Huber et al. | 184/3 A |
| 2,643,738 | 6/1953 | Magnus | 184/3 A |
| 2,779,291 | 1/1957 | Albright | 417/405 X |
| 2,965,036 | 12/1960 | Wood | 418/200 X |

*Primary Examiner*—David H. Brown

*Attorney, Agent, or Firm*—Watson, Cole, Grindle & Watson

[57] ABSTRACT

A railway track lubricating apparatus which includes a multiplicity of applicators positioned next to a rail to be lubricated, a lubricant-containing supply tank, a lubricant pump having a gear drive element and a gear pump element located in the supply tank, a lubricant delivery system connected between the gear pump element and the various applicators, an actuator element in the form of a piston pump located on the side of the rail, and a hydraulic fluid recirculation system connected between the actuator element and the gear drive element, the recirculation system including a storage receptacle located inside the supply tank.

7 Claims, 3 Drawing Figures

HYDRAULIC FLUID-OPERATED RAILWAY TRACK LUBRICATING APPARATUS

BACKGROUND OF THE INVENTION

1. Field of the Invention

The present invention relates to an apparatus used to lubricate the rails of a railway track, and more specifically to such an apparatus which is located on or in the ground next to the rails to be lubricated and which is activated by the passing of the wheels of a railway vehicle thereby. In particular, the present invention is directed to such a lubricating apparatus which operates as the result of the forced internal circulation of a hydraulic fluid.

2. Description of the Prior Art

Lubricating devices which are positioned next to the rails of a railway track and which are activated by the passage of the wheels of a railway vehicle thereover to discharge a lubricant onto the rail head are well known, the application of lubricant to the rails having long ago been found to reduce the frictional wear on the rail head and the degree of noise resulting from contact between the vehicle wheels (especially the wheel flanges) and the rail head. Many of the known lubricating devices include a lubricant-containing supply tank located in the ground near the rail, one or more lubricant distributing elements positioned on one side of the rail, a pump in the supply tank capable of conveying lubricant through one or more pipes to the lubricant distributing elements, and an actuator element located along the length of the rail and suitably connected to the pump to operate it in response to the passage thereover of a railway vehicle wheel.

In some of these prior art lubricating devices the connection between the actuator element and the pump in the supply tank is purely mechanical, utilizing an elongated rotatable drive rod with attendant joints, springs, bearings, etc. However, these mechanical components deteriorate in time due to wear and tear, and since in order to function they must necessarily be located above the ground next to the rail, they are easily damaged by vehicle derailment or dragging equipment. Thus, lubricating systems using these mechanical connections are often not desirable.

Other lubricating devices are known wherein the connection between the actuator element and the pump in the supply tank consists of either a single hydraulic fluid line or a recirculating fluid loop in which a hydraulic fluid such as a light oil is caused to flow by the activation of the actuator element. A device of the former type is shown in U.S. Pat. No. 2,355,241 to Rodman et al wherein a single pipe connects the actuator element to the pump in the lubricant supply tank and wherein activation of the actuator element causes a hydraulic fluid to flow from the actuator element through the pipe towards the pump so as to operate it. However, in this system both the actuator element and the pump function by the expansion and contraction of bellows elements therein, and these bellows elements will break down over time due to the experienced expansion and contraction stresses, necessitating inconvenient and costly replacement.

A device of the latter type is shown in U.S. Pat. No. 2,401,303 to Huber wherein a recirculating fluid loop connects the actuator element to the pump in the lubricant supply tank and wherein activation of the actuator element causes a hydraulic fluid to flow through the loop to operate the pump. However, the actuator element used is very complicated in construction and thus expensive and difficult to service, and the pump, being in the form of a gun pump, has an intricate internal mechanism and is subject to troublesome breakdown.

It is thus an object of the present invention to provide a lubricating apparatus for the rail of a railway track which will be reliable, simple in construction, relatively inexpensive, and protectable from damage due to vehicle derailment and/or physical impacts resulting from dragging equipment.

SUMMARY OF THE PRESENT INVENTION

According to the present invention, which relates to a railway track lubricating apparatus of the known type which employs a hydraulic fluid recirculating loop between the actuator element and the lubricant pump in the lubricant-containing supply tank, the lubricant pump is in the form of a combined gear drive-gear pump device, the gear drive element being driven by the flow of a hydraulic fluid therethrough and the gear pump element being driven by the gear drive element so as to force lubricant from the supply tank to the lubricant distributing elements mounted on the side of the rail to be lubricated; the actuator element is in the form of a piston pump so as to force a hydraulic fluid through the recirculating loop to the gear drive element of the lubricant pump when the plunger therein is depressed by the passage of the wheel of a railway vehicle thereover; and the hydraulic fluid recirculating loop includes a hydraulic fluid-containing storage receptacle located within the lubricant-containing supply tank. According to the present invention, both the pipes in the delivery system connected between the gear pump element of the lubricant pump and the distributing elements and the pipes of the hydraulic fluid recirculating system located near the actuator element will be buried below ground level to protect them from damage.

A further understanding of the features and advantages of the present invention will be had from a review of the attached drawing and the following description.

DETAILED DESCRIPTION OF THE PREFERRED EMBODIMENT

Figures 1, 2, 3:
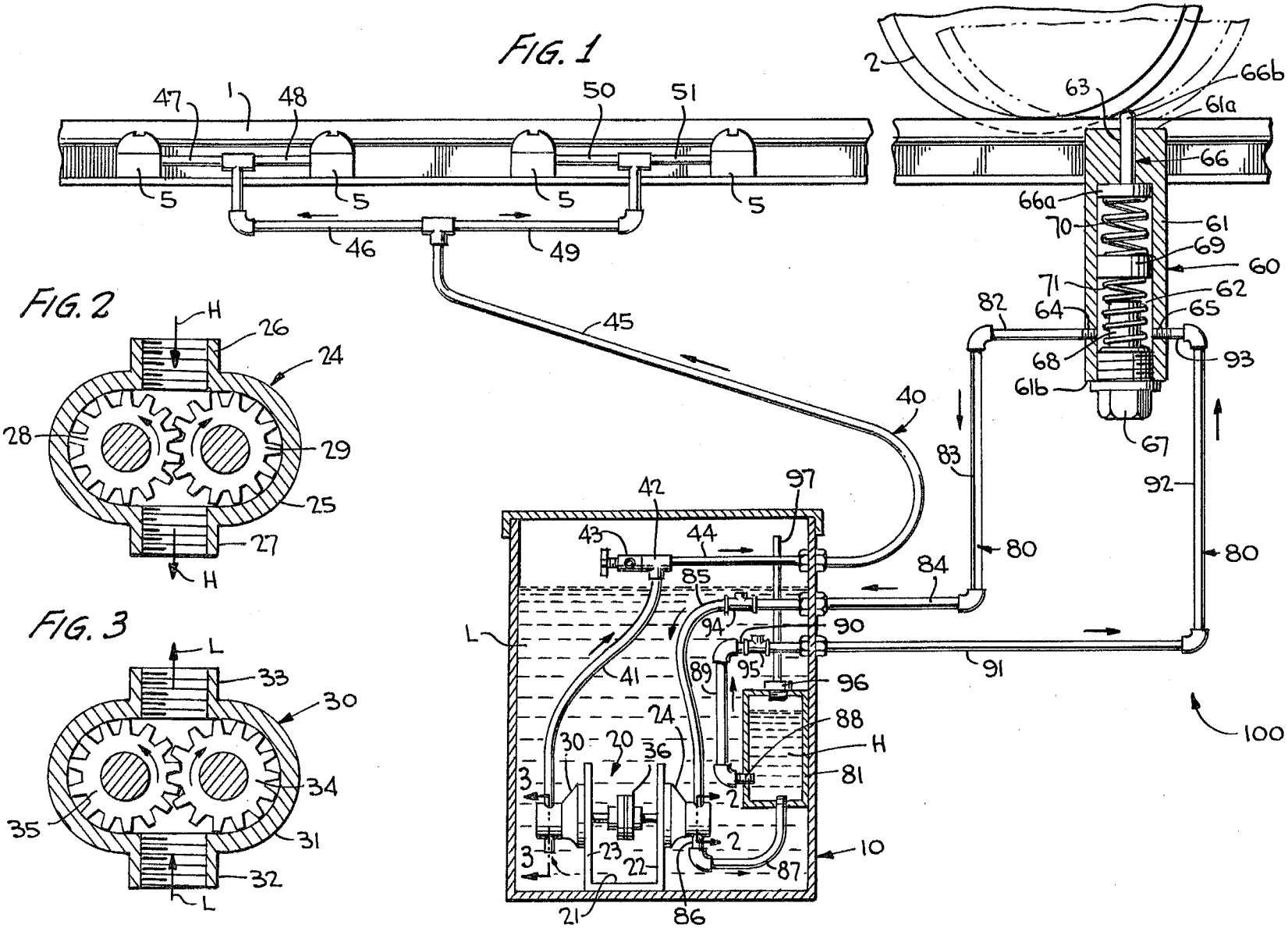
FIG. 1 shows a schematic representation of the hydraulic fluid-operated railway track lubricating apparatus according to the present invention, the lubricating apparatus being operatively positioned adjacent a rail of a railway track.
FIGS. 2 and 3 show respective cross-sectional views along lines 2—2 and 3—3 in FIG. 1 showing internal features of the lubricant pump located inside of the lubricant supply tank of the inventive lubricating apparatus.

The inventive hydraulic fluid-operated railway track lubricating apparatus, generally identified in FIG. 1 as 100, is shown positioned adjacent a rail 1 of a railway track so as to supply lubricant thereto in response to the passage of a wheel 2 of a railway vehicle along the rail 1. As will become apparent from the following discussion of the components which make up the inventive lubricating apparatus, many of them can be buried below ground level, thus avoiding possible damage thereto due to railway vehicle derailment or other physical impacts.

The inventive lubricating apparatus 100 includes a covered supply tank 10 which contains a lubricant L (such as grease); a series of applicators 5 which are positioned in spaced apart fashion along the side of the rail 1; a lubricant pump 20 which is located within the supply tank 10; a lubricant delivery system, generally labeled 40, which is connected between the lubricant pump 20 and the applicators 5 so as to convey lubricant pumped from the supply tank 10 to each of the various applicators 5; an actuator element 60 which is positioned along the side of the rail 1; and a hydraulic fluid recirculation system, generally labeled 80, which is connected between the actuator element 60 and the pump 20 to circulate hydraulic fluid H (such as a light oil) from actuator element 60 to lubricant pump 20 and back again.

Considering in detail first the structure of the lubricant pump 20, it includes a gear drive element 24 and a gear pump element 30, the gear drive element 24 being mounted on the outer side of an upstanding leg 22 of the frame 21 and the gear pump element 30 being mounted on the outer side of an upstanding leg 23. A flexible coupling element 36 extends between the two upstanding legs 22 and 23 and through openings therein to operatively interconnect the gear drive element 24 with the gear pump element 30.

As can be seen from FIG. 2, the gear drive element 24 includes a hollow, elliptically-shaped housing 25 which includes hollow couplings 26 and 27 on opposite sides which include internal threads so that they can be sealingly connected to the ends of pipes, these hollow couplings providing for the flow of a hydraulic fluid centrally into and out of opposite sides of the housing 25. Rotatably mounted within the housing 25 are a pair of toothed gears 28 and 29 which are not only positioned such that their teeth intermesh, but which are sized such that their outer surfaces extend to points adjacent the inner surfaces of the opposite semi-circular ends of the elliptically-shaped housing 25. A forced flow of a hydraulic fluid H into the gear drive housing 25 via the hollow coupling 26 will cause the intermeshed toothed gears 28 and 29 to rotate as shown by the arrows in FIG. 2, the hydraulic fluid then being discharged from the housing via the hollow coupling 27.

As can be seen from FIG. 3, the gear pump element 30 includes a hollow, elliptically-shaped housing 31 which includes a hollow coupling 32 and a hollow coupling 33 located on opposite sides, the hollow coupling 32 being open to the lubricant L in the supply tank 10 and the hollow coupling 33, due to its internal threads, being sealingly connectable to the end of a pipe so as to provide for the flow of lubricant L centrally into and out of opposite sides of the housing 31. Rotatably mounted within housing 31 are a pair of toothed gears 34 and 35 which are not only positioned such that their teeth intermesh, but which are sized such that their outer surfaces extend to points adjacent the inner surfaces of the opposite semi-circular ends of the elliptically-shaped housing 31. The flexible coupling 36 will be connected between gear 29 in the gear drive element housing 25 and the gear 35 in the gear pump element 31; thus, a forced flow of lubricant L into the hollow flange 32, through housing 31 and out the hollow coupling 33 will result from the rotation of intermeshed toothed gears 34 and 35 (as shown by the arrows in FIG. 3) when the gears 28 and 29 in the gear drive housing are forced to rotate by the passage of hydraulic fluid from hollow coupling 26 through housing 25, and out hollow coupling 27.

It should be noted that although the lubricant pump 20 has been shown mounted on the floor of the supply tank 10, it could be positioned therein at other locations as long as the mouth of the hollow flange 32 of the gear pump element 30 is located below the level of the lubricant L in the storage tank 10.

Turning now to the construction of the lubricant delivery system 40 which connects the lubricant pump 20 with the various applicators 5, in the shown embodiment it includes a first pipe 41 which is threadingly connected at one end to the hollow coupling 33 of the gear pump element housing 31 and at its other end with a second pipe 44 via a coupling element 42. The second pipe 44 extends through the wall of the supply tank 10 in a fluid-tight fashion and then via a series of pipes 45–51 and suitable coupling elements (not labeled) is connected to the various applicators 5. A spigot 43 is connected to the coupling element 42 inside the supply tank 10 which can be adjusted so as to control the total amount of lubricant L passed through the lubricant delivery system to the applicators 5. Some or all of the pipes in the pipe delivery system 40 can be composed of rigid materials (plastic or metal), whereas if desired some can be composed of flexible materials. In any event, the pipes extending between the supply tank 10 and the applicators 5 can be buried below ground level so as to protect them from damage. Obviously the total number of pipes and the number of couplings used in the lubricant delivery system 40 will vary depending on the number of applicators 5 used, the location of the lubricator pump 20 inside the supply tank 10, etc.

The actuator element 60 includes an elongated block 61 having a top surface **61*a*, a bottom surface 61*b*, a cylindrical piston chamber 62 extending inwardly from the bottom surface 61*b* and a cylindrical bore 63 extending between the piston chamber 62 and the top surface 61*a*, the piston chamber having larger diameter than the bore. The block 61 includes internal threads (not labeled) near the bottom surface 61*b* and two opposed radial openings 64, 65 communicating with the piston chamber. A T-shaped plunger is 66 is positioned inside of housing 61 such that the base 66*a* fits within and is movable along the piston chamber 62, and the stem 66*b* is movable along the bore 63. The stem is sufficiently long that its tip extends beyond the top surface 61*a* of the housing 61 when the base 66*a* is located at the end of the piston chamber 62. Threadingly attached to the internal threads at the end of the block 61 is a threaded plug 67 having an upwardly exending piston stop 68. Positioned in the piston chamber 62 of housing 61 so as to be movable therealong is a piston 69, the piston being spaced apart from the base 66*a* of plunger 66 by a coiled spring 70 and from the upwardly extending piston stop 68 of plug 67 by a coiled spring 71. Coiled spring 70 will be much heavier in construction and stronger than coiled spring 71; thus, the piston 69 will be forced by spring 70 to move towards the piston stop 68 of threaded plug 67 when the plunger 66 is depressed into the piston chamber 62, whereas the piston will be returned by spring 71 to its original position when the plunger 66 is free to move. When the piston 69 moves downwardly, hydraulic fluid in chamber 62 therebelow will be forced out of radial opening 64, whereas the piston moves upwardly to its original position, hydraulic fluid will be sucked into chamber 62 below the piston through radial opening 65**.

The hydraulic fluid recirculating system 80 which connects the activator element 60 with the gear drive element 24 of lubricator pump 20, includes a storage receptacle 81 having a bottom, sides and a top mounted inside the supply tank 10, a first conduit means in the form of pipes 82–85 and connectors (not labeled) which connects the opening 64 in the block 61 of activator element 60 with the hollow coupling 26 of gear drive housing 25, a second conduit means in the form of pipes 86–87 and connector (not labeled) which connects the hollow coupling 27 of the gear drive housing 25 with the bottom of the storage receptacle 81, and a third conduit means in the form of pipes 88–93 and connectors (not labeled) which connects the storage receptacle 81 with the opening 65 in the block 61 of actuator element 60. One way check valves 94 and 95 are respectively connected in the first conduit means between pipes 84 and 85 and in the third conduit means between pipes 90 and 91 and inside of the supply tank 10 so as to allow for hydraulic fluid passage through the system 80 in only one direction (counterclockwise as shown in FIG. 1). Obviously the number of pipes in the first, second and third conduit means of the pipe system 80 and the number of couplings could be varied depending on the location of the lubricator pump 20 in the supply tank 10, the location of the storage receptacle in the supply tank 10, etc. The pipes in the first and third conduit means near the actuator element 60 can be buried below ground level so as to protect them from damage. The top of the supply tank 10 includes a threaded hole in which a threaded cap 96 having a hollow vent pipe 97 is engaged, the hollow vent pipe extending upwardly to the air spaced above the lubricant L in supply tank 10.

A full operational cycle of the inventive lubricating system will be as follows: when the wheel 2 of a railway vehicle passes over the activator element 60, thereby depressing plunger 66, the piston 69 therein will move towards the piston stop 68 of plug 67, and, due to the controlling action of the one way check valves 94 and 95 in the hydraulic fluid recirculating system 80, hydraulic fluid H will be forced to pass through the radial opening 64, through the first conduit means, through the gear drive element 24 of the lubricant pump 20 in the fashion shown in FIG. 2, through the second conduit means and into the bottom of storage receptacle 81. The resultant rotation of the gears 28 and 29 will, via the concurrent rotation of rotatable flexible coupling 36, cause the gears 34 and 35 in gear pump element 30 to rotate in the fashion shown in FIG. 3, thereby causing lubricant L to flow through the lubricant delivery system 40 to the applicators 5 and be utimately discharged onto the rail 1. After the wheel 2 of the railway vehicle has passed over the activator element 60, the coiled spring 71 will cause the piston 69 to move back to its original position, and due to the controlling action of one way check valves 94 and 95, hydraulic fluid will be sucked from storage receptacle 81 through the third conduit means and through the radial opening 65 in the block 61 to refill the portion of the chamber between the piston 69 and the plug 67.

Although a preferred embodiment of the invention has been described in detail, it is obvious that various modifications can be made thereto and still be within the scope of the invention as defined in the appended claims.

I claim:

1. In a railway track lubricating apparatus which includes at least one applicator element for applying lubricant to a rail of a railway track, a supply tank containing lubricant positionable near the rail, a lubricant pump mounted in said supply tank, a lubricant delivery system connecting said lubricant pump and each applicator element, an actuator element mountable along the length of the rail to be activated by the wheel of a railway vehicle passing thereover, and a hydraulic fluid recirculation system connected between said actuator element and said lubricant pump to operate said lubricant pump when said actuator element is activated, the improvement wherein said lubricant pump includes a gear drive element, a gear pump element and a rotatable, flexible coupling element connected therebetween; said gear drive element including a hollow, elliptically-shaped housing having hollow couplings extending outwardly from opposite sides and a pair of rotatable toothed gears mounted therein which are intermeshed with one another; said gear pump element including a hollow, elliptically-shaped housing having hollow couplings extending outwardly from opposite sides and a pair of rotatable toothed gears mounted therein which are intermeshed with one another; and said rotatable, flexible coupling element connecting one of the toothed gears in said gear drive element housing with one of the toothed gears in said gear pump element housing, the end of said lubricant delivery system which is connected to said lubricant pump being connected to one of said hollow couplings of said gear pump housing, said actuator element comprising an elongated block having a top surface and a bottom surface and including a internal-piston chamber extending inwardly from the bottom surface of said housing and a bore communicating between said piston chamber and the top surface of said housing, the piston chamber being larger in dimensions than said bore, said block including threads near said bottom surface and two radial openings communicating with said piston chamber, a T-shaped plunger having a base and a stem mounted in said block such that the base is movable along said piston chamber and the stem is movable along said bore, a plug threadingly connected to the threads on said block to enclose the opening of said piston chamber at the bottom surface of said block, a piston located in said piston chamber to be axially movable therealong, a first coiled spring positioned between said base of said plunger and said piston, and a second coiled spring positioned between said plunger and said plug, and said hydraulic fluid recirculation system comprising a fluid-containing storage receptacle having a bottom, sides and a top mounted in said supply tank, a first conduit means connecting one of said radial openings in said actuator element block with one of the hollow couplings of said gear drive element housing, a second conduit means connecting the other of said hollow couplings of said gear drive element housing with the bottom of said storage receptacle; and a third conduit means connecting a side of the storage receptacle with the other of said radial openings in said actuator element block, each of said first and third conduit means including a one-way check valve so as to allow hydraulic fluid in said recirculation system to flow therethrough in only one direction.

2. The railway track lubricating apparatus as set forth in claim 1 wherein said first coiled spring in said actuator element block is stronger than said second coiled spring therein.

3. The railway track lubricating apparatus as set forth in claim 1 wherein said plug includes a piston stop portion which extends into said piston chamber.

4. The railway track lubricant apparatus as defined in claim 1 wherein said lubricant pump includes a generally U-shaped frame having a base and two legs, wherein said gear drive element is attached to the outer side of one of said two legs, wherein the gear pump element is attached to the outer side of the second of said two legs, and said rotatable, flexible coupling element is connected across and through openings in each of said legs.

5. The railway track lubricant apparatus as defined in claim 1 wherein means forming a vent are connected between said top of said storage receptacle and the air space above the lubricant in said supply tank.

6. The railway track lubricating apparatus as defined in claim 1 wherein each of said pair of toothed gears of said gear drive element are sized such that their outer surfaces will extend to points adjacent the inner surfaces of the semi-circular ends of the elliptically-shaped gear drive element housing, and wherein each of said pair of toothed gears of said gear pump element are sized such that their outer surfaces will extend to points adjacent the inner surfaces of the semi-circular ends of the elliptically-shaped gear pump element housing.

7. The railway track lubricating apparatus as defined in claim 6 wherein said second and third conduit means in said hydraulic fluid recirculating system are respectively connected to the hollow couplings of said gear drive element housing such that the flow of hydraulic fluid through said gear drive element housing will cause the toothed gears therein to rotate in a fashion that the gears in said gear pump element housing will rotate to cause lubricant to enter the gear pump element housing via one of its hollow couplings and exit the gear pump element housing via the other of its hollow couplings.

* * * * *